US011807003B2

(12) United States Patent
Mori et al.

(10) Patent No.: US 11,807,003 B2
(45) Date of Patent: Nov. 7, 2023

(54) LIQUID EJECTION HEAD AND MANUFACTURING METHOD THEREOF

(71) Applicant: CANON KABUSHIKI KAISHA, Tokyo (JP)

(72) Inventors: Tatsurou Mori, Tokyo (JP); Takuya Iwano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 35 days.

(21) Appl. No.: 17/707,492

(22) Filed: Mar. 29, 2022

(65) Prior Publication Data

US 2022/0314620 A1 Oct. 6, 2022

(30) Foreign Application Priority Data

Mar. 31, 2021 (JP) ..... 2021-061614

(51) Int. Cl.
*B41J 2/14* (2006.01)

(52) U.S. Cl.
CPC ..... *B41J 2/14145* (2013.01); *B41J 2/14032* (2013.01); *B41J 2/14072* (2013.01)

(58) Field of Classification Search
CPC ..... B41J 2/14145; B41J 2/14032; B41J 2/14072; B41J 2/1408; B41J 2/14024; B41J 2202/12; B41J 2202/20
See application file for complete search history.

(56) References Cited

U.S. PATENT DOCUMENTS

2017/0197420 A1* 7/2017 Okushima ..... B41J 2/1404

FOREIGN PATENT DOCUMENTS

JP 2017213871 A 12/2017
JP 2020049778 A 4/2020

* cited by examiner

*Primary Examiner* — Lisa Solomon
(74) *Attorney, Agent, or Firm* — Canon U.S.A., Inc. I.P. Division

(57) ABSTRACT

A liquid ejection head includes a recording element substrate, a flow path member having a common supply flow path and a common collection flow path through which a liquid having a temperature higher than a temperature of the common supply flow path flows, and a support member supporting the flow path member. The common supply flow path and the common collection flow path are formed to extend along a longitudinal direction of the flow path member and be arranged side by side with each other in a lateral direction of the flow path member. The positions of the flow path member in the longitudinal direction and in the lateral direction are defined at a center portion in the longitudinal direction, and at a side surface located on the common supply flow path side in the lateral direction, among side surfaces extending in the longitudinal direction, respectively.

17 Claims, 20 Drawing Sheets

81

LIQUID EJECTION HEAD AND MANUFACTURING METHOD THEREOF

BACKGROUND OF THE DISCLOSURE

Field of the Disclosure

The present disclosure relates to a liquid ejection head and a manufacturing method thereof.

Description of the Related Art

In recent years, high-speed recording is required in a liquid ejection device used for commercial and industrial applications such as production of retail photographs, drawing of electronic circuits, or production of panel displays. In order to realize the high-speed recording, a line-type liquid ejection head may be provided. The liquid ejection head is configured such that a plurality of recording element substrates are arranged side by side in a row, a length in a longitudinal direction (recording width) is equal to or more than a recording target width of a recording medium, and a large number of ejection orifices are used.

Japanese Patent Application Laid-Open No. 2017-213871 and Japanese Patent Application Laid-Open No. 2020-49778 discuss a configuration in which a common supply flow path and a common collection flow path straddling a plurality of recording element substrates of a liquid ejection head are provided to supply a liquid and collect the liquid, for each recording element substrate. Japanese Patent Application Laid-Open No. 2017-213871 discusses a configuration in which a heating unit that heats a liquid is provided on a recording element substrate to realize high-quality recording. Japanese Patent Application Laid-Open No. 2020-49778 discusses a configuration in which an overhanging portion is provided at each end portion of each recording element substrate and this overhanging portion is fixed to a support member supporting each recording element substrate by a screw to reduce position displacement of an ejection orifice.

In the invention described in Japanese Patent Application Laid-Open No. 2017-213871, a liquid to be supplied from the common supply flow path to the recording element substrate is heated by the heating unit, and then at least a part of the heated liquid flows into the common collection flow path without being ejected to the outside. As a result, a temperature of the liquid flowing through the common collection flow path becomes higher than a temperature of the liquid flowing through the common supply flow path, and a temperature distribution occurs. Due to this temperature distribution, a flow path member in which the common supply flow path and the common collection flow path are formed may be deformed. When the flow path member is deformed, a position of each recording element substrate disposed to overlap with the flow path member is displaced, landing position accuracy of a droplet ejected from the recording element substrate is lowered, and a quality of recording by liquid ejection deteriorates. This effect can be more pronounced in a long line-type liquid ejection head for high-speed recording, and can be difficult to solve even in the configuration described in Japanese Patent Application Laid-Open No. 202049778 or a configuration in which a mechanism capable of finely adjusting a position of the liquid ejection head or the recording element substrate is provided.

SUMMARY OF THE DISCLOSURE

Aspects of the present disclosure are directed to a liquid ejection head and a manufacturing method thereof capable of ejecting a liquid with high accuracy by suppressing deformation caused by a temperature distribution of a flow path member in which a common supply flow path and a common collection flow path are formed.

According to the present disclosure, there is provided a liquid ejection head including a recording element substrate having an ejection orifice which ejects a liquid; a flow path member having a common supply flow path through which the liquid is supplied to the recording element substrate, and a common collection flow path which collects the liquid from the recording element substrate and through which a liquid having a temperature higher than a temperature of the liquid flowing through the common supply flow path flows; and a support member which supports the flow path member, in which the common supply flow path and the common collection flow path are formed to extend along a longitudinal direction of the flow path member, and be arranged side by side with each other in a lateral direction of the flow path member, and a position of the flow path member with respect to the support member in the longitudinal direction is defined at a center portion in the longitudinal direction, a position of the flow path member in the lateral direction is defined at a side surface located on the common supply flow path side in the lateral direction, among side surfaces extending in the longitudinal direction, and a position of the flow path member with respect to the support member in a thickness direction is fixed while being defined at least in the center portion in the longitudinal direction.

Further features of the present disclosure will become apparent from the following description of exemplary embodiments with reference to the attached drawings.

DESCRIPTION OF THE EMBODIMENTS

Hereinafter, exemplary embodiments of the present disclosure will be described with reference to the drawings. Meanwhile, the following descriptions do not limit the scope of the present disclosure. The exemplary embodiment to be described below relates to a thermal type liquid ejection head in which a heat generating element, which is an energy generating element, generates heat energy to generate bubbles by the heat and eject a liquid. Meanwhile, the present disclosure can also be applied to a liquid ejection head that employs a piezo method or various other liquid ejection methods. Further, the exemplary embodiment to be described below relates to a liquid ejection device (ink jet recording device) in which a liquid such as ink is circulated between a tank and a liquid ejection head, and the present disclosure can also be applied to a liquid ejection device having another form. For example, a configuration may be provided in which two tanks are provided on an upstream side and a downstream side of a liquid ejection head and a liquid flows from one tank to the other tank such that the liquid in a pressure chamber flows without being circulated. Further, a liquid ejection head of the exemplary embodiment to be described below is a so-called line-type liquid ejection head having a recording width corresponding to a recording target width of a recording target medium, the recording width being equal to or larger than the recording target width. Meanwhile, the present disclosure can also be applied to a so-called serial type liquid ejection head that ejects a liquid while scanning a recording target medium. Examples of the serial type liquid ejection head include a liquid ejection head at which a recording element substrate for black ink and a recording element substrate for color ink are respectively mounted. A short liquid ejection head shorter than a recording target width of a recording target medium may be manufactured by arranging a plurality of recording element substrates side by side in a state of being overlapped with each other such that ejection orifices overlap in an ejection orifice row direction, for scanning the recording target medium with the liquid ejection head.

[Description of Basic Configuration of Liquid Ejection Device]

Figure 1:
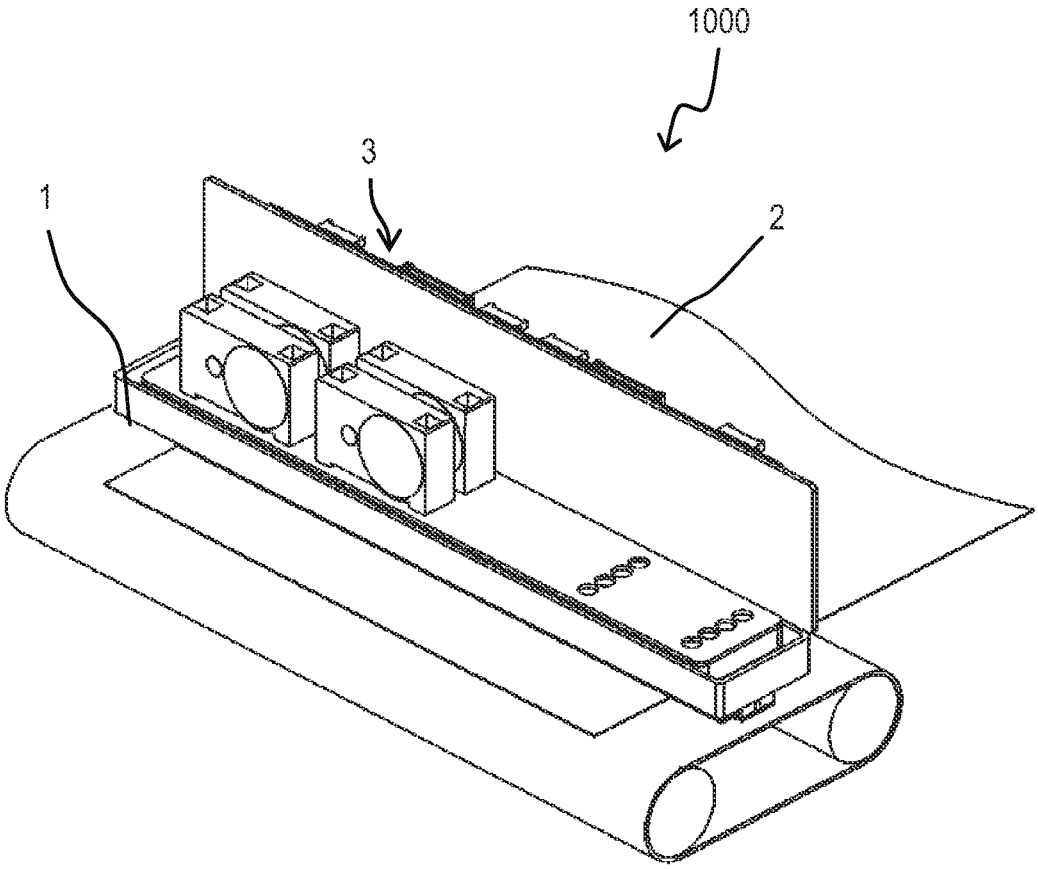
FIG. 1 is a schematic configuration view of a liquid ejection device including a liquid ejection head according to an exemplary embodiment of the present disclosure.

FIG. 1 illustrates a schematic configuration of an ink jet recording device 1000 (hereinafter, also referred to as a recording device) that ejects liquid ink to perform recording, which is an example of a liquid ejection device including a liquid ejection head according to the present disclosure. The recording device 1000 includes a transport portion 1 that transports a recording target medium 2, and a long line-type liquid ejection head 3 that extends in a direction substantially orthogonal to a transport direction of the recording target medium 2. The recording device 1000 is a line-type recording device that continuously performs recording in one pass while continuously or intermittently transporting the recording target medium 2. The recording target medium 2 is not limited to cut paper, and may be continuous roll paper. The liquid ejection head 3 is an ink jet recording head capable of full-color recording by ejecting four colors of liquid ink of cyan, magenta, yellow, and black (CMYK). As will be described later, a liquid supply unit included in a supply path for supplying a liquid to the liquid ejection head 3, a main tank 1006, and a buffer tank 1003 (see FIG. 2) are fluidly connected to the liquid ejection head 3. Further, an electric control portion that transmits electric power and an ejection control signal to the liquid ejection head 3 is electrically connected to the liquid ejection head 3. A liquid path and an electric signal path in the ejection head 3 will be described later.

(Description of Circulation Path)

Figure 2:
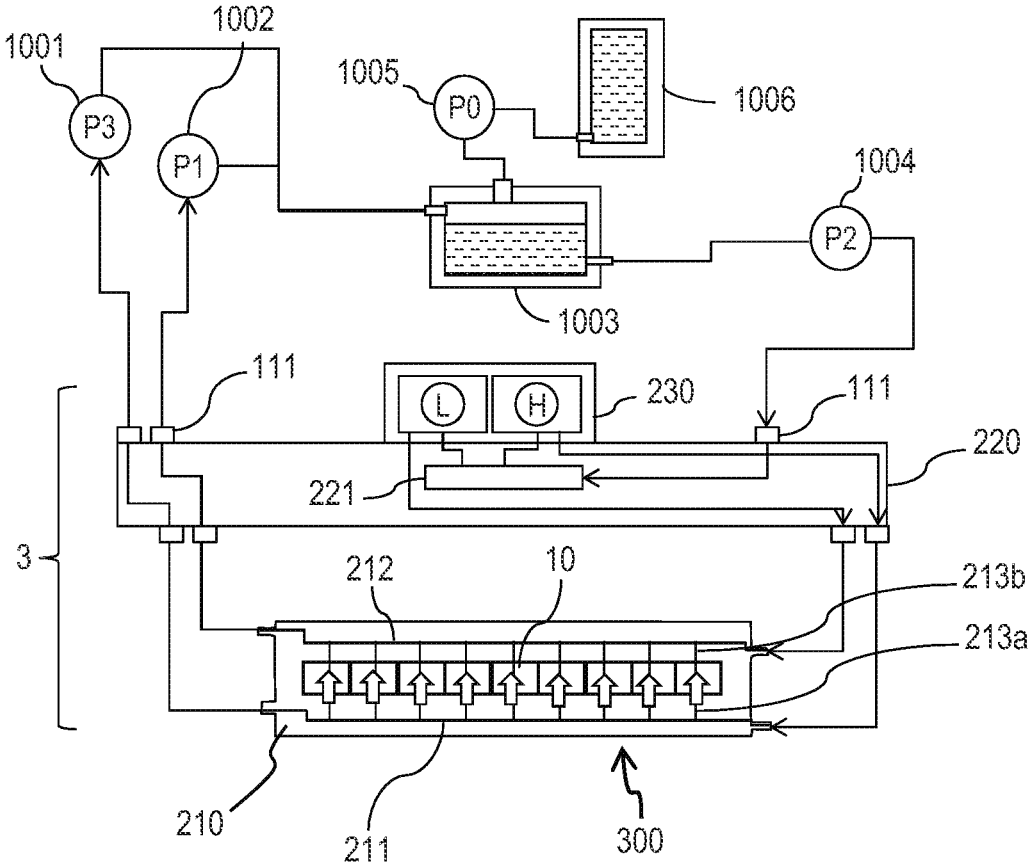
FIG. 2 is a schematic diagram of a liquid circulation path of the liquid ejection device illustrated in FIG. 1.

FIG. 2 is a schematic diagram illustrating a circulation path which is a liquid path of a recording device according to the present exemplary embodiment. FIG. 2 illustrates a state in which the liquid ejection head 3 is fluidly connected to a first circulation pump 1002, a second circulation pump 1004, a third circulation pump 1001, the buffer tank 1003, and the like. In FIG. 2, for simplification of the description, only the liquid path through which one of the four colors of CMYK liquid ink flows is illustrated. The liquid ejection head 3 mainly has a liquid ejection unit 300, a liquid supply unit 220, and a negative pressure control unit 230. The buffer tank 1003 is a sub-tank connected to the main tank 1006 via a replenishment pump 1005. The buffer tank 1003 includes an atmospheric communication port (not illustrated) that communicates an inside and an outside of the buffer tank 1003, and can discharge air bubbles in the liquid to the outside. When a liquid is ejected (discharged) from an ejection orifice 10*a* (see FIGS. 3A and 5) of the liquid ejection head 3 for recording, suction recovery, or the like and the liquid in the liquid ejection head 3 is consumed, the replenishment pump 1005 transfers the amount of consumed liquid from the main tank 1006 to the buffer tank 1003.

The first circulation pump 1002 has a function of drawing out a liquid from a liquid connection portion 111 of the liquid ejection head 3 and flowing the liquid to the buffer tank 1003. As the first circulation pump 1002, a positive displacement pump having a quantitative liquid feeding capacity, specifically, for example, a tube pump, a gear pump, a diaphragm pump, a syringe pump, or the like can be used. Meanwhile, a pump in which a general constant flow rate valve or a relief valve is disposed at a pump outlet to secure a constant flow rate can also be used as the first circulation pump 1002. When the liquid ejection head 3 is driven, a certain amount of liquid flows in a common collection flow path 212 by the first circulation pump 1002. A flow rate of the liquid can be set to a flow rate or higher so that a temperature difference between respective recording element substrates 10 of the liquid ejection unit 300 does not affect a recording image quality. Meanwhile, if the flow rate is too large, a negative pressure difference between the respective recording element substrates 10 becomes too large due to an influence of a pressure loss in a flow path in the liquid ejection unit 300, and density unevenness occurs in a recorded image formed by liquid ejection. Therefore, the flow rate can be set in consideration of the temperature difference and the negative pressure difference between the respective recording element substrates 10.

The negative pressure control unit 230 is provided in a path between the second circulation pump 1004 and the liquid ejection unit 300. The negative pressure control unit 230 has a function that operates to maintain a pressure on a downstream side (liquid ejection unit 300 side) of the negative pressure control unit 230 within a preset constant pressure range even in a case where the flow rate of the circulation path fluctuates due to the difference in a duty for recording. As two pressure regulating mechanisms included in the negative pressure control unit 230, any mechanism may be used as long as the pressure fluctuation on the downstream side can be suppressed within the constant pressure range centered on a predetermined set pressure. As an example of the pressure regulating mechanism, a so-called decompression regulator can be adopted. In a case where the decompression regulator is used as the pressure regulating mechanism, the second circulation pump 1004 can pressurize an upstream side of the negative pressure control unit 230 via the liquid supply unit 220, as illustrated in FIG. 2. As a result, an influence of a water head pressure on the liquid ejection head 3 of the buffer tank 1003 can be suppressed, so that the degree of freedom in a layout of the buffer tank 1003 in the recording device 1000 can be increased. The second circulation pump 1004 may be a turbo type pump, a positive displacement pump, or the like, as long as the second circulation pump 1004 has a lift pressure of a certain value or more in a range of an ink circulation flow rate when the liquid ejection head 3 is driven. Specifically, a diaphragm pump or the like is usable as the second circulation pump 1004.

Further, instead of the second circulation pump 1004, it is also possible to use, for example, a water head tank disposed with a certain water head difference with respect to the negative pressure control unit 230.

As illustrated in FIG. 2, the negative pressure control unit 230 includes two pressure regulating mechanisms in which different control pressures are respectively set. A pressure regulating mechanism H on a relatively high-pressure side is connected to one end of a common supply flow path 211 of a flow path member 210 of the liquid ejection unit 300 via the liquid supply unit 220. The other end of the common supply flow path 211 is connected to the third circulation pump 1001 via the liquid supply unit 220. A pressure regulating mechanism L on a relatively low-pressure side is connected to one end of the common collection flow path 212 of the flow path member 210 of the liquid ejection unit 300 via the liquid supply unit 220. The other end of the common collection flow path 212 is connected to the first circulation pump 1002 via the liquid supply unit 220. An individual supply flow path 213*a* and an individual collection flow path 213*b* are provided at the flow path member 210 of the liquid ejection unit 300. The individual supply flow path 213*a* communicates with the common supply flow path 211 and each recording element substrate 10. The individual collection flow path 213*b* communicates with the common collection flow path 212 and each recording element substrate 10. Therefore, a part of a liquid flowing by the first circulation pump 1002 passes from the common supply flow path 211 to the common collection flow path 212 through an internal flow path of the recording element substrate 10 (illustrated by an arrow in FIG. 2).

This is because a pressure difference is provided between the pressure regulating mechanism H connected to the common supply flow path 211 and the pressure adjustment mechanism L connected to the common collection flow path 212, and the first circulation pump 1002 is not connected to the common supply flow path 211 but is connected to the common collection flow path 212.

In this manner, in the liquid ejection unit 300, a flow of the liquid passing through the common collection flow path 212, and a flow passing from the common supply flow path 211 to the common collection flow path 212 through each recording element substrate 10 are generated. Therefore, heat generated in each recording element substrate 10 can be discharged to an outside of the recording element substrate 10 by the flow from the common supply flow path 211 to the common collection flow path 212. Further, with such a configuration, when the liquid is ejected from the liquid ejection head 3, the liquid can flow even in an ejection orifice or a pressure chamber from which the liquid is not ejected. As a result, thickening of the liquid in the ejection orifice or the pressure chamber can be suppressed, and the thickened liquid or a foreign matter in the liquid can be discharged to the common collection flow path 212. Therefore, the liquid ejection head 3 according to the present exemplary embodiment can perform recording with a high image quality at a high speed.

(Description of Configuration of Liquid Ejection Head)

Figure 3A:
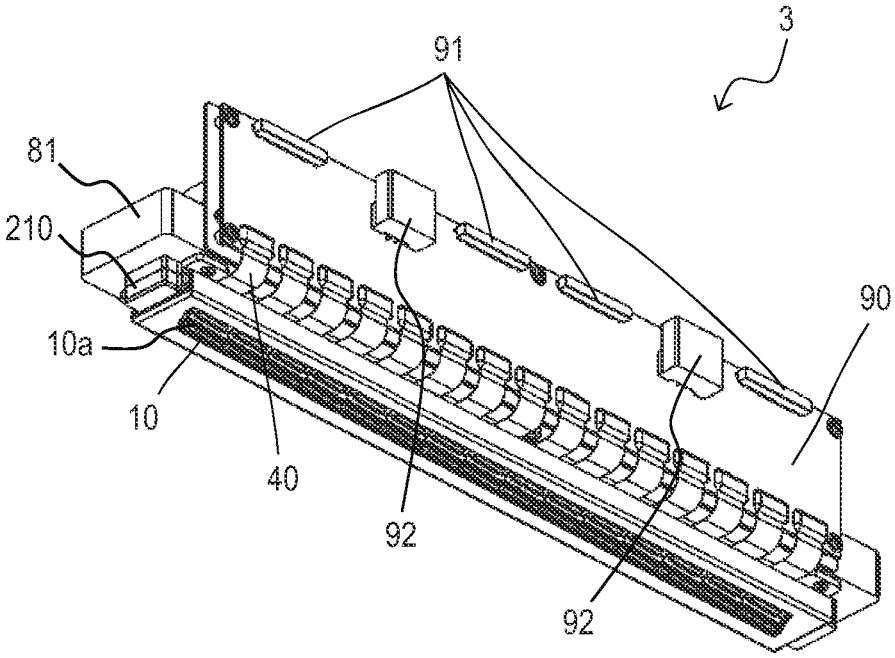
FIG. 3A is a perspective view of the liquid ejection head of the liquid ejection device illustrated in FIG. 1.
Figure 3B:
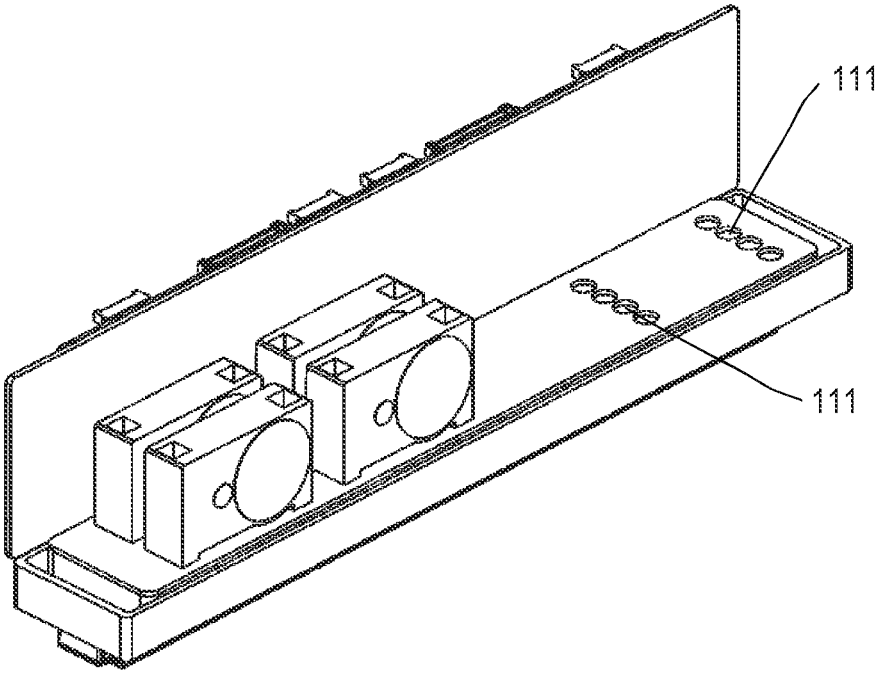
FIG. 3B is another perspective view of the liquid ejection head of the liquid ejection device illustrated in FIG. 1.

A configuration of the liquid ejection head 3 according to the present exemplary embodiment will be described. FIGS. 3A and 3B are perspective views of the liquid ejection head 3 according to the present exemplary embodiment. The liquid ejection head 3 is a line-type liquid ejection head in which the 15 recording element substrates 10 capable of ejecting liquid inks of a plurality of colors are linearly (inline) arranged. Each of the recording element substrates 10 may have a plurality of ejection orifice 10*a*, and may be arranged on a flow path member in a state in which at least parts of the ejection orifices 10*a* overlap with each other.

As illustrated in FIG. 3A, the liquid ejection head 3 includes a plurality of recording element substrates 10, a plurality of flexible wiring substrates 40, and an electric wiring substrate 90 electrically and respectively connected to each recording element substrate 10 via each flexible wiring substrates 40. The electric wiring substrate 90 includes a signal input terminal 91, a power supply terminal 92, and a connection terminal 93 (see FIG. 4).

The signal input terminal 91 and the power supply terminal 92 are electrically connected to a control portion of the recording device main body, and respectively supply an ejection drive signal and electric power required for ejection to the recording element substrate 10. By integrating wirings by an electric circuit in the electric wiring substrate 90, the number of the signal input terminals 91 and the power supply terminals 92 can be reduced as compared with the number of the recording element substrates 10. As a result, the number of electric connection portions required to be detached when assembling the liquid ejection head 3 to the recording device main body or when replacing the liquid ejection head 3 can be reduced. The flexible wiring substrate 40 connected to the recording element substrate 10 is connected to the connection terminal 93 of the electric wiring substrate 90. As illustrated in FIG. 3B, the liquid connection portion 111 provided on one side of the liquid ejection head 3 is connected to a liquid path of the recording device main body. As a result, liquid ink is supplied from the liquid path of the recording device main body to the liquid ejection head 3, and the liquid ink passing through the liquid ejection head 3 is collected to the liquid path of the recording device main body. In this manner, the liquid ink of each color can be circulated through the liquid path of the recording device main body and the liquid path of the liquid ejection head 3.

Figure 4:
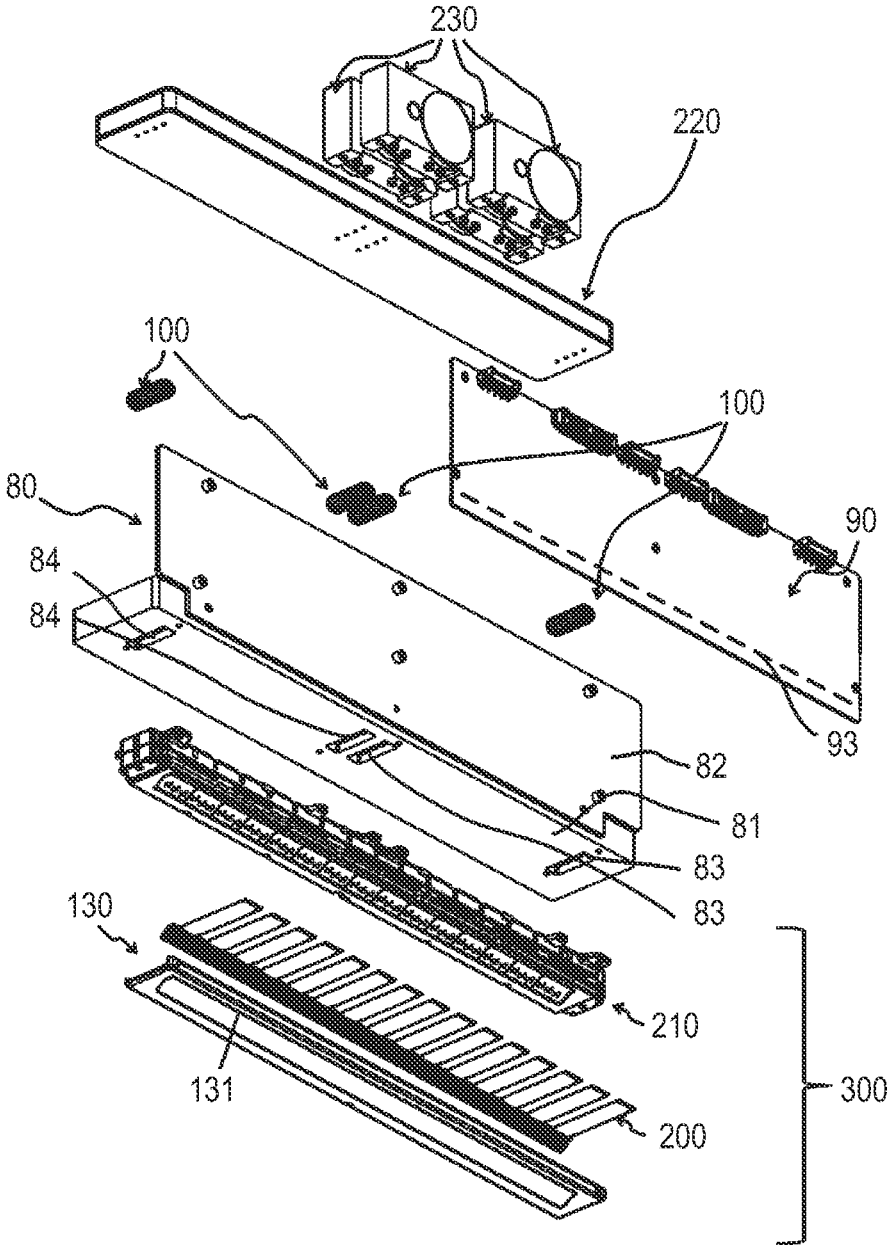
FIG. 4 is an exploded perspective view of the liquid ejection head illustrated in FIGS. 3A and 3B.

FIG. 4 illustrates an exploded perspective view of each member included in the liquid ejection head 3. In the liquid ejection head 3, the liquid ejection unit 300, the liquid supply unit 220, and the electric wiring substrate 90 are attached to a housing 80. The liquid supply unit 220 is provided with the liquid connection portion 111 (see FIG. 3B). Inside the liquid supply unit 220, a filter 221 for each color (for example, for four colors) communicating with each opening of the liquid connection portion 111 is provided (see FIG. 2) so as to remove foreign matters in a supplied liquid. The liquid passing through the filter 221 is supplied to the negative pressure control unit 230 provided on the liquid supply unit 220 corresponding to each color. The negative pressure control unit 230 is a unit including a pressure regulating valve for each color. The negative pressure control unit 230 significantly reduces a change in pressure loss inside the liquid path (a supply path on an upstream side of the liquid ejection head 3) of the recording device main body, which is generated by a fluctuation in flow rate of the liquid, due to the action of a valve, a spring member, or the like provided inside each negative pressure control unit 230. Further, the negative pressure control unit 230 stabilizes a change in negative pressure on a downstream side (liquid ejection unit 300 side) of the negative pressure control unit 230, due to the action of the valve, the spring member, or the like, within a certain range. As illustrated in FIG. 2, inside the negative pressure control unit 230 for each color, the two pressure regulating mechanisms H and L set to different control pressures for each color are included. The pressure regulating mechanism H on the high-pressure side communicates with the common supply flow path 211 in the liquid ejection unit 300 via the liquid supply unit 220, and the pressure regulating mechanism L on the low-pressure side communicates with the common collection flow path 212 via the liquid supply unit 220.

The housing 80 includes a liquid ejection unit support portion (hereinafter, also referred to as a support member) 81 and an electric wiring substrate support portion 82 to support the liquid ejection unit 300 and the electric wiring substrate 90 and secure rigidity of the liquid ejection head 3. The electric wiring substrate support portion 82 is fixed to the support member 81 by screwing to support the electric wiring substrate 90. The support member 81 corrects warpage and deformation of the liquid ejection unit 300, secures relative position accuracy of the plurality of recording element substrates 10, and suppresses streaks or unevenness in a recorded image by liquid ejection. Therefore, the support member 81 can have sufficient rigidity, and can be made of a metal material such as stainless steel or aluminum, or a ceramic material such as alumina. The support member 81 is provided with openings 83 and 84, and a joint rubber 100 is inserted into the openings 83 and 84. The liquid supplied from the liquid supply unit 220 is guided to the flow path member 210 of the liquid ejection unit 300 via the joint rubber 100.

The liquid ejection unit 300 includes a plurality of ejection modules 200 and the flow path member 210.

The ejection module 200 includes the recording element substrate 10 and an element substrate support plate 30 (see FIG. 5) that supports the recording element substrate 10. A cover member 130 is attached to a surface of the liquid ejection unit 300 on the recording target medium side. The flow path member 210 has a configuration in which a plurality of plate-shaped members are stacked in a thickness direction. The flow path member 210 is a member for distributing the liquid supplied from the liquid supply unit 220 to each ejection module 200, and returning the liquid refluxed from the ejection module 200 to the liquid supply unit 220. The flow path member 210 is fixed to the support member 81 by screwing, whereby warpage or deformation of the flow path member 210 is suppressed. Therefore, it is desirable that a linear expansion rate of a material of the support member 81 is equal to or less than a linear expansion rate of a material of the flow path member 210. The flow path member 210 can be made of a material having corrosion resistance against liquid and having the low linear expansion rate. As the material of the flow path member 210, for example, a composite resin material including alumina, liquid crystal polymer (LCP), polyphenyl sulfide (PPS), polysulfone (PSF) or modified polyphenylene ether (PPE) as a base material can be appropriately used. The composite resin material may be obtained by adding an inorganic filler such as silica fine particles or fibers to the base material described above. The flow path member 210 may be formed by stacking a plurality of plate-shaped members and adhering the members to each other. Further, in a case where the composite resin material is selected as the material of the flow path member 210, the flow path member 210 may be formed by stacking a plurality of plate-shaped members and welding the members to each other.

As illustrated in FIG. 4, the cover member 130 is a frame-shaped member provided with a long opening 131. The recording element substrate 10 and a sealing material (not illustrated) included in the ejection module 200 are exposed from the opening 131. A frame portion surrounding the opening 131 has a function as an abutting surface of a capping member that caps the liquid ejection head 3 during liquid ejection standby. Therefore, a coating agent such as an adhesive, a sealing material, or a filler can be applied along the periphery of the opening 131, and the coating agent can fill roughness or a gap on an ejection orifice surface of the liquid ejection unit 300 at the time of capping such that a closed space is formed.

Figure 5:
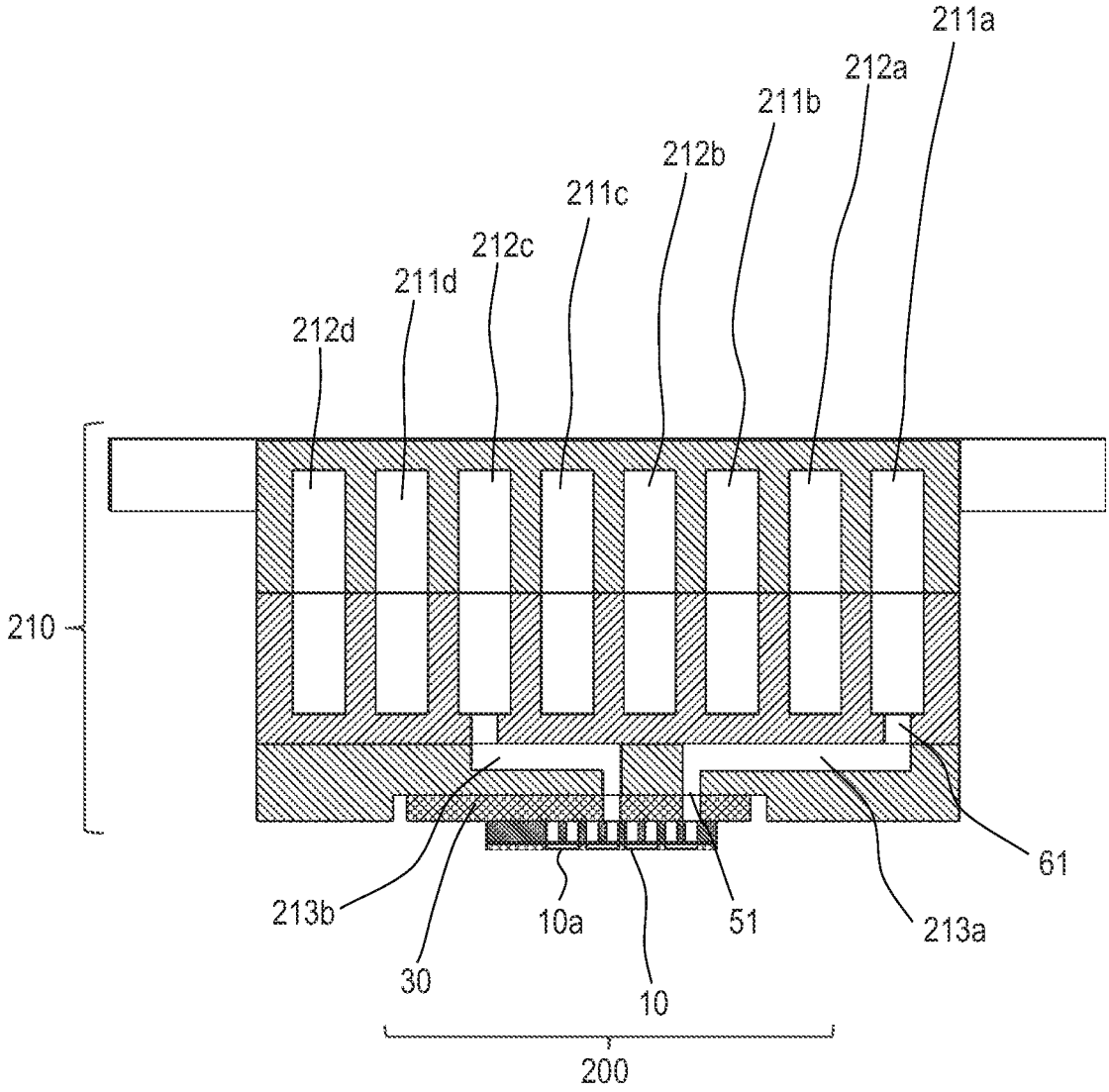
FIG. 5 is a cross-sectional view of a part of the liquid ejection head illustrated in FIGS. 3A and 3B cut along a lateral direction.

FIG. 5 is a diagram illustrating a cross-section of the liquid ejection head 3 according to the present exemplary embodiment cut along a lateral direction. As illustrated in FIG. 2, the common supply flow path 211 of each color is connected to the pressure regulating mechanism H on the high-pressure side of the negative pressure control unit 230 of the corresponding color, via the liquid supply unit 220. The common collection flow path 212 of each color is connected to the pressure regulating mechanism L on the low-pressure side of the negative pressure control unit 230 of the corresponding color, via the liquid supply unit 220. The negative pressure control unit 230 causes a differential pressure (pressure difference) between the common supply flow path 211 and the common collection flow path 212. As illustrated in FIG. 5, the common supply flow paths 211*a* to 211*d* and the common collection flow paths 212*a* to 212*d* of the respective colors are respectively connected to the individual supply flow path 213*a* and the individual collection flow path 213*b*, via the communication port 61. The individual supply flow path 213*a* and the individual collection flow path 213*b* are respectively connected to a liquid path in the ejection module 200, via the communication port 51. Therefore, in the liquid ejection head 3 according to the present exemplary embodiment, for each color, flows are generated in order from the common supply flow paths 211*a* to 211*d* to the common collection flow paths 212*a* to 212*d*, via the individual supply flow path 213*a*, the recording element substrate 10, and the individual collection flow path 213*b*.

Figure 6A:
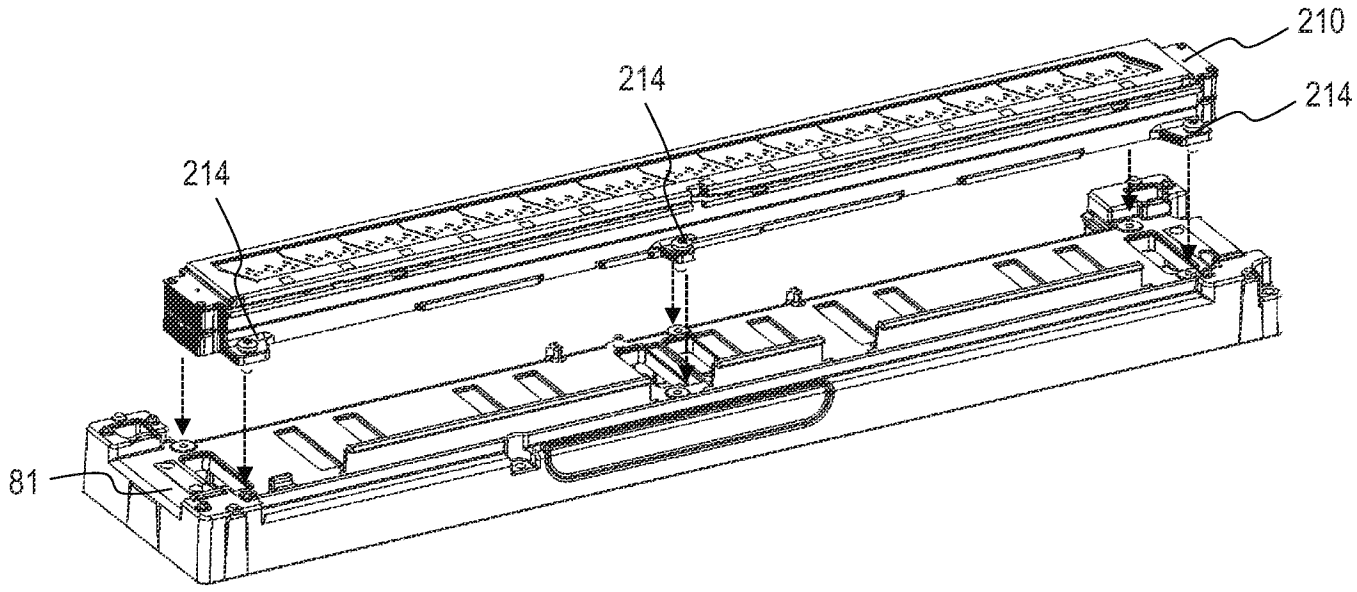
FIG. 6A is an exploded perspective view of a flow path member and a support member of the liquid ejection head illustrated in FIGS. 3A and 3B.
Figure 6B:
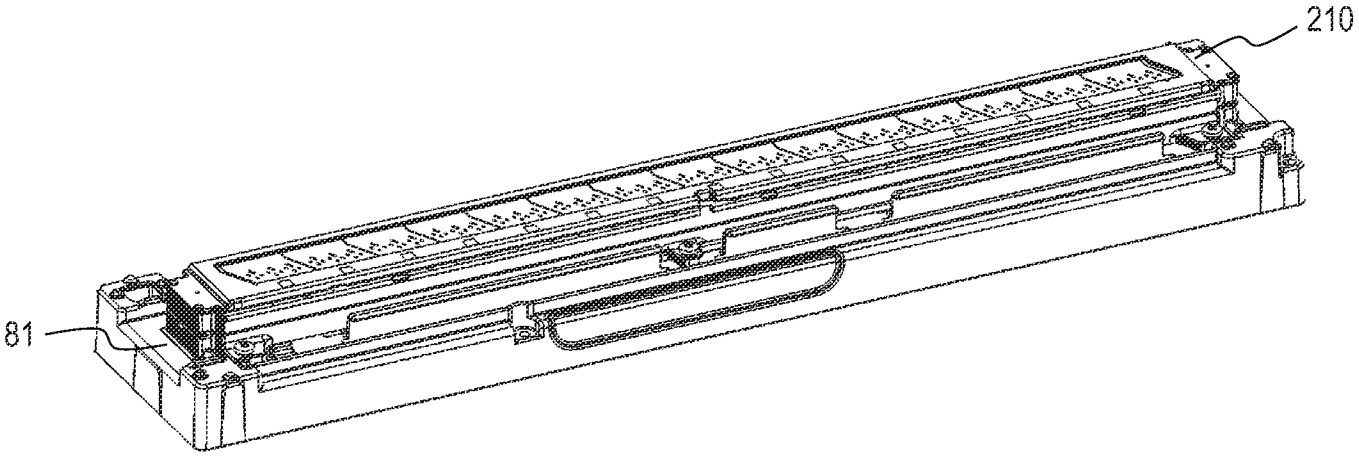
FIG. 6B is a perspective view of an assembled state of the flow path member and the support member of the liquid ejection head illustrated in FIGS. 3A and 3B.
Figure 7A:
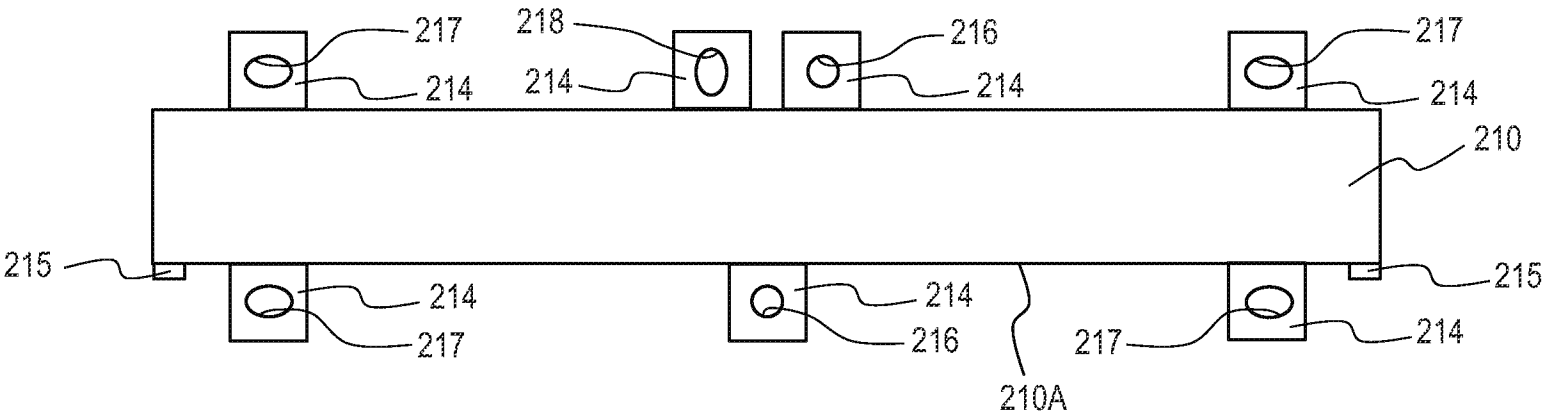
FIG. 7A is a schematic plan view of the flow path member illustrated in FIG. 6B.
Figure 7B:
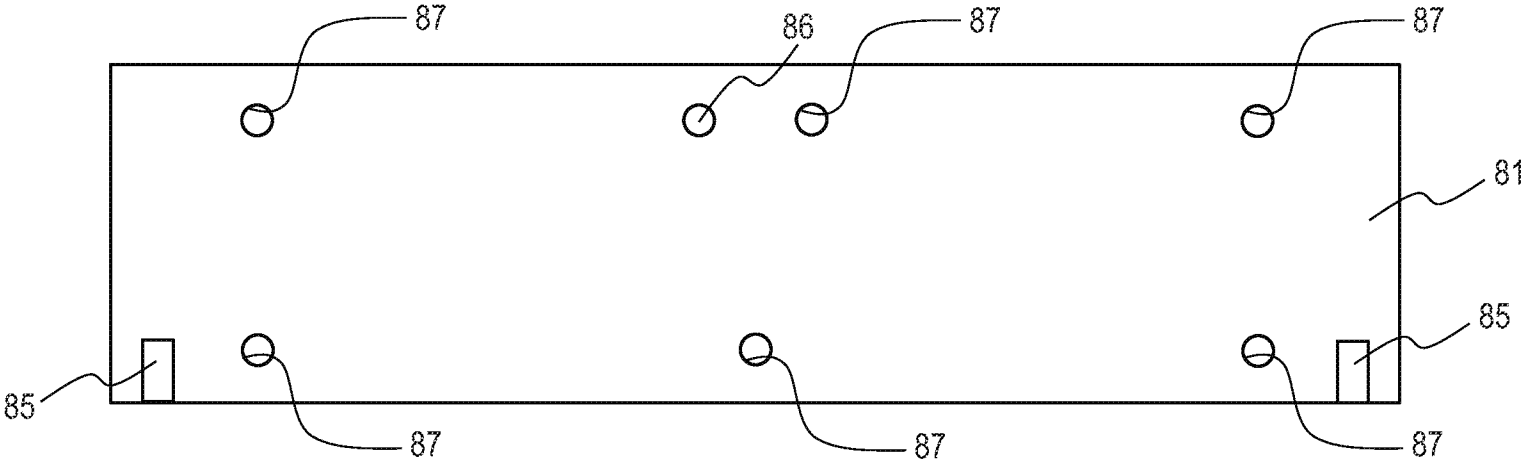
FIG. 7B is a schematic plan view of the support member of the flow path member illustrated in FIG. 6B.
Figure 8A:
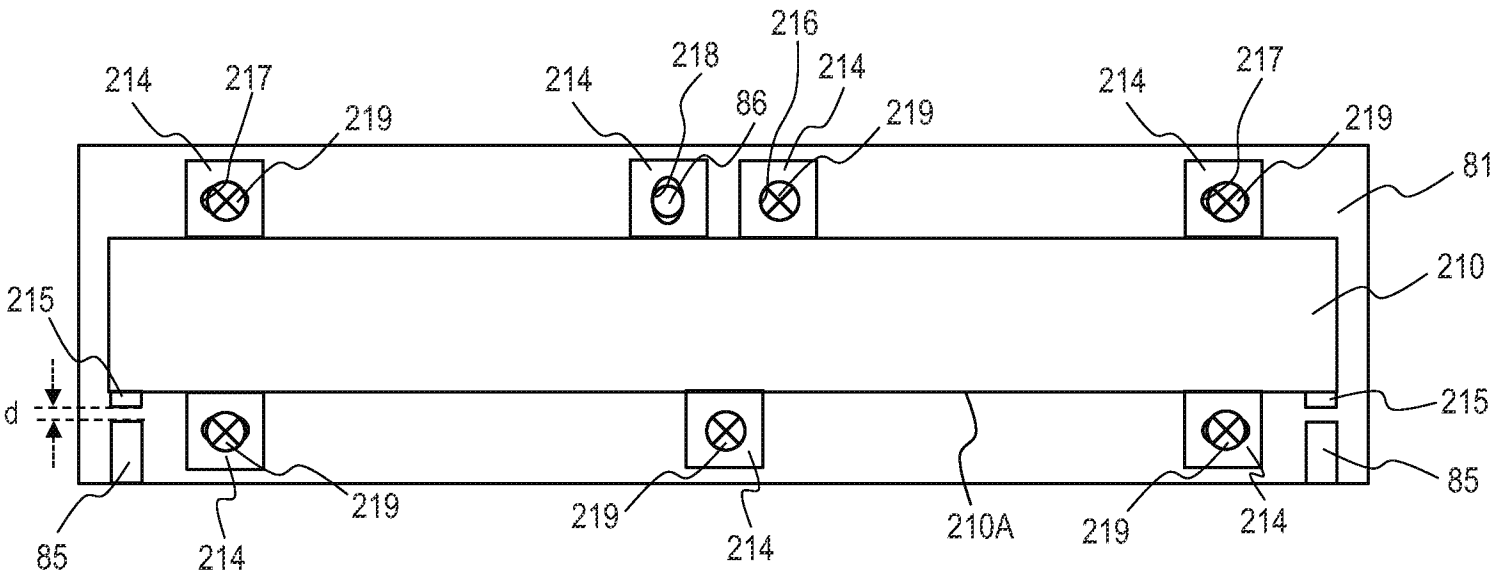
FIG. 8A is a schematic plan view illustrating a fixed state between the flow path member and the support member illustrated in FIGS. 7A and 7B.
Figure 8B:
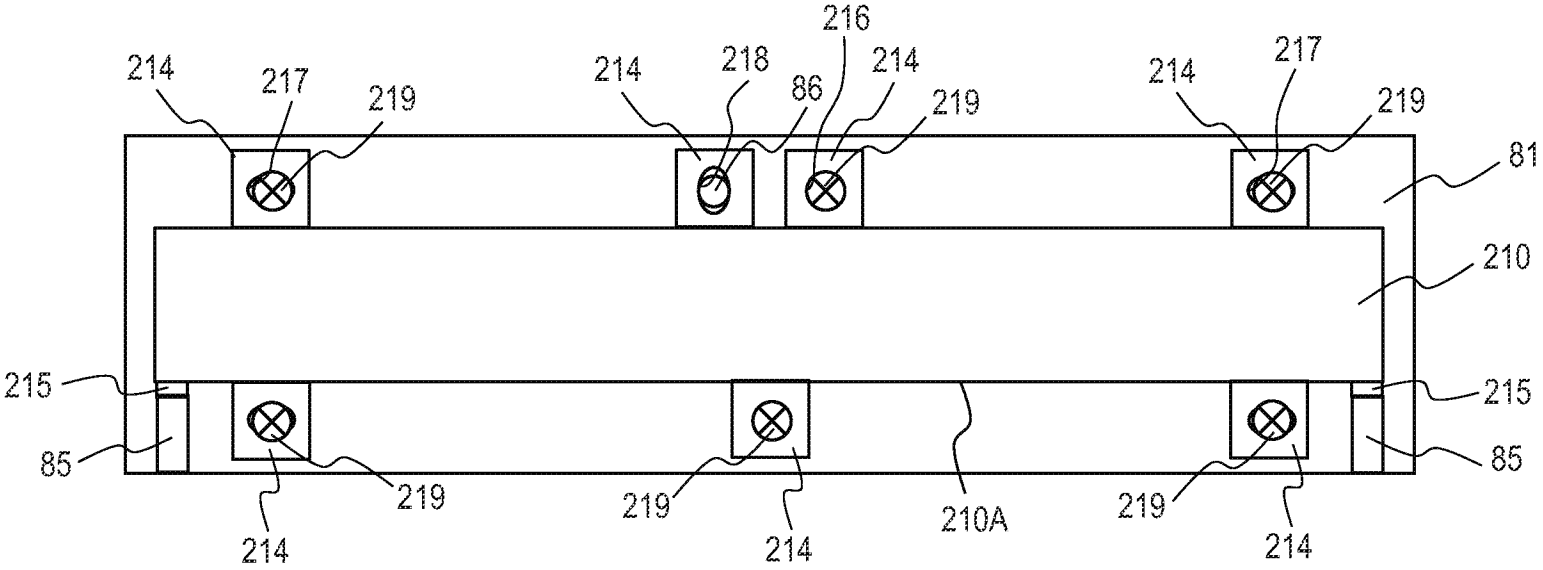
FIG. 8B is another schematic plan view illustrating the fixed state between the flow path member and the support member illustrated in FIGS. 7A and 7B.

A fixed state of the flow path member 210 and the support member 81 of the liquid ejection head 3 according to the present exemplary embodiment will be described. FIG. 6A is an exploded perspective view of the flow path member 210 and the support member 81. FIG. 6B is a perspective view of an assembled state of the flow path member 210 and the support member 81. FIG. 7A is a schematic plan view of the flow path member 210 illustrated in FIG. 6A. FIG. 7B is a schematic plan view of the support member 81 illustrated in FIG. 6A. FIGS. 8A and 8B are schematic plan views illustrating a state in which the flow path member 210 illustrated in FIG. 6A is fixed to the support member 81. FIGS. 7A, 7B, 8A, and 8B illustrate a part of a configuration simplified for easy understanding.

In the present exemplary embodiment, seven fixing portions 214 and two positioning portions 215 are formed along an outer periphery of the flow path member 210. Each of the fixing portions 214 is formed with each of screw through-holes 216 and 217 or a positioning slot 218. That is, the round hole-shaped screw through-hole 216 is formed at the two fixing portions 214 among the three fixing portions 214 located at a substantially center portion of the flow path member 210 in a longitudinal direction. The positioning slot 218 having a major axis of the flow path member 210 in a lateral direction is formed at the remaining one fixing portion 214. The slot-shaped screw through-hole 217 having a major axis of the flow path member 210 in the longitudinal direction is formed at the four fixing portions 214 of both side portions of the flow path member 210 in the longitudinal direction. The positioning portion 215 is formed at a side surface 210A located on the common supply flow path side in the lateral direction, among side surfaces of the flow path member 210 extending in the longitudinal direction. The positioning portion 215 is located closer to an end portion than the fixing portions 214 in the longitudinal direction on both side portions of the flow path member 210 in the longitudinal direction. In the present specification, the center portion in the longitudinal direction does not mean only one center point, but means a region including the center point. As used herein, the side portions in the longitudinal direction means not only an end portion in the longitudinal direction, but a region closer to the end portion than the center portion in the longitudinal direction.

Abutting portions 85 are formed at positions of the support member 81 facing the positioning portions 215 on both side portions of the flow path member 210 in the longitudinal direction. A positioning pin 86 is formed at a position of the support member 81 corresponding to the positioning slot 218 in the center portion of the flow path member 210 in the longitudinal direction. Screw holes 87 are respectively formed at positions of the support member 81 corresponding to the screw through-holes 216 and 217 of the flow path member 210. The flow path member 210 and the support member 81 are fixed to each other by a screw 219 that penetrates the screw through-holes 216 and 217 of the flow path member 210 and is screwed into the screw hole 87 of the support member 81. The screw through-holes 216 and 217 and the positioning slot 218 have dimensions larger than the diameter of the screw 219, respectively, in consideration of a dimensional tolerance of the flow path member 210 and the support member 81. As illustrated in FIG. 8A, the flow path member 210 and the support member 81 may be fixed to each other with an interval (gap) d of, for example, 50 μm or less between the positioning portion 215 and the abutting portion 85. In that case, the positioning portion 215 and the abutting portion 85 define a relative position of the flow path member 210 and the support member 81 in the lateral direction with accuracy of 50 μm or less. Meanwhile, as illustrated in FIG. 8B, the flow path member 210 and the support member 81 may be fixed to each other in a state in which the positioning portion 215 and the abutting portion 85 abut against each other. Further, when the positioning portion 215 is formed at a position closer to the end portion of the flow path member 210 in the longitudinal direction, an influence of one-sided contact of the flow path member 210 on the abutting portion 85 can be reduced and more appropriate positioning can be performed.

At a time of manufacturing the liquid ejection head according to the present exemplary embodiment, the positioning pin 86 of the support member 81 is inserted into a positioning slot of the flow path member 210 before the flow path member 210 and the support member 81 are fixed to each other. As a result, the flow path member 210 is positioned in the longitudinal direction. Meanwhile, the positioning pin 86 is movable in a major axis direction of the positioning slot 218, that is, in the lateral direction of the flow path member 210, inside the positioning slot 218. Therefore, the flow path member 210 is relatively movable to the support member 81 in the lateral direction, within a range in which the positioning pin 86 is located in the positioning slot. In this manner, the flow path member 210 is supported with respect to the support member 81 so as to be movable in the lateral direction and immovable in the longitudinal direction.

When the abutting portion 85 of the support member 81 abuts on the positioning portion 215 of the flow path member 210 in a state in which the positioning pin 86 is inserted into the positioning slot of the flow path member 210, a movement of the flow path member 210 with respect to the support member 81 in the lateral direction is regulated. Therefore, the positioning pin 86 is held inside the positioning slot 218, and the abutting portion 85 cannot be further approached when the abutting portion 85 abuts on the positioning portion 215 so as to perform positioning of the flow path member 210 and the support member 81 in the lateral direction.

The screws 219 are screwed into the screw holes 87 of the support member 81 through the slot-shaped screw through-holes 217 located at both side portions of the flow path member 210 in the longitudinal direction. The screw 219 and the slot-shaped screw through-hole 217 further ensure the positioning of the flow path member 210 with respect to the support member 81 in the lateral direction. Meanwhile, the slot-shaped screw through-hole 217 and the screw 219 do not regulate a movement of the flow path member 210 with respect to the support member 81 in the longitudinal direction. The screw 219 is screwed into the screw hole 87 of the support member 81 through the slot-shaped screw through-hole 216 located at the center portion of the flow path member 210 in the longitudinal direction. By screwing the screw 219 into the screw hole 87 of the support member 81 through the screw through-holes 216 and 217 in this manner, the flow path member 210 is fixed to the support member 81 while being positioned in the thickness direction with respect to the support member 81. In this manner, the flow path member 210 is fixed to the support member 81 with high positional accuracy, and warpage of the flow path member 210 in the thickness direction is suppressed.

Figure 9:
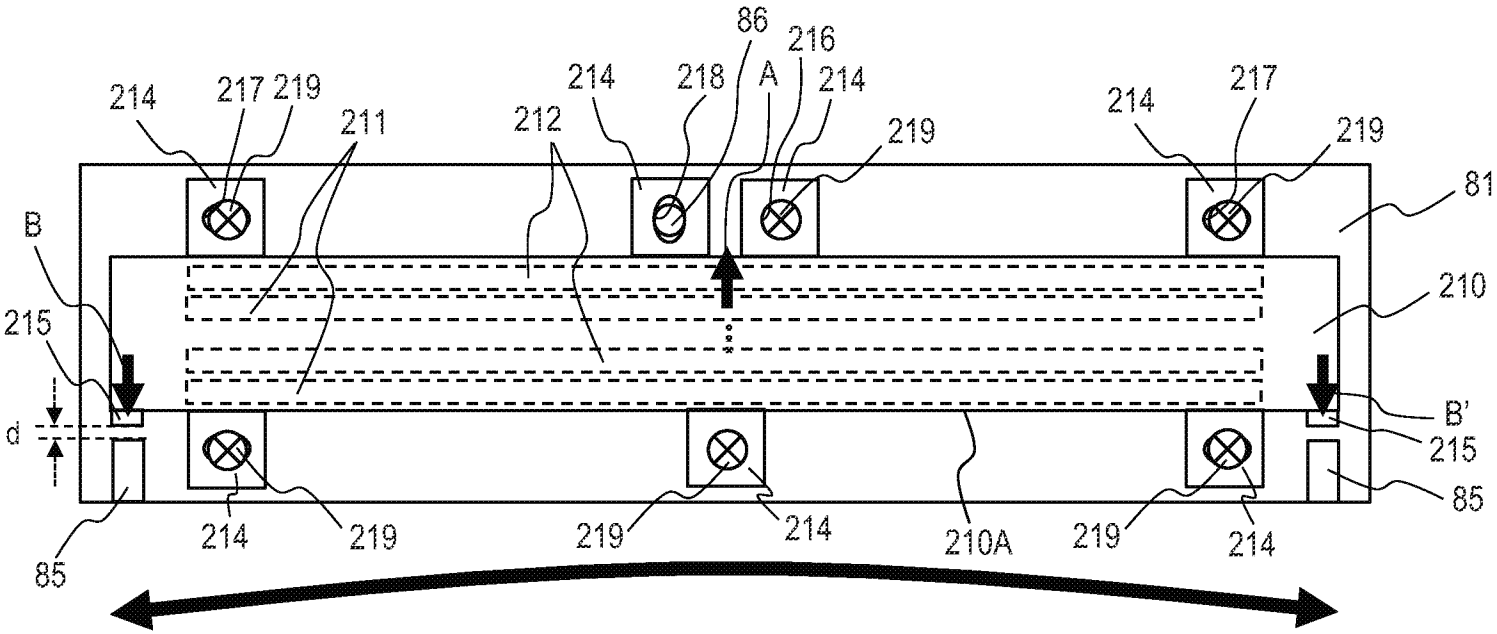
FIG. 9 is a schematic plan view illustrating a deformed state of the flow path member between the flow path member and the support member illustrated in FIGS. 8A and 8B.

FIG. 9 is a schematic diagram illustrating a deformed state of the flow path member 210 along the longitudinal direction of the flow path member 210. FIG. 9 illustrates a part of a configuration simplified for ease of understanding. As illustrated in FIG. 9, the common supply flow path 211 and the common collection flow path 212 of each color are alternately arranged in the lateral direction of the flow path member 210, and are formed parallel to each other along the longitudinal direction of the flow path member 210. Although not illustrated, the recording element substrate 10 has a heat generating portion that heats a liquid in the recording element substrate. The heat generating portion may be an energy generating element that generates heat energy for ejecting the liquid in the recording element substrate (pressure chamber) from the ejection orifice, and may be a temperature adjusting element that adjusts a temperature of the liquid in the recording element substrate (pressure chamber). The heat generating portion may include both the temperature adjusting element and the energy generating element. The liquid flowing through the common collection flow path 212 is a liquid collected after being heated by the heat generating portion of the recording element substrate 10, and therefore has a higher temperature than the liquid flowing through the common supply flow path 211. Therefore, a temperature distribution is generated in the common supply flow path 211 and the common collection flow path 212, and the flow path member 210 is deformed as schematically illustrated by an arrow in FIG. 9. Specifically, in the flow path member 210, thermal expansion on the common collection flow path 212 side through which the relatively high-temperature liquid flows is larger than thermal expansion on the common supply flow path 211 side through which the relatively low-temperature liquid flows. Therefore, when the flow path member 210 is deformed by force indicated by the arrows A, B, and B' in FIG. 9, among the side surfaces of the flow path member 210 extending in the longitudinal direction, the positioning portion 215, formed at the side surface 210A located on the common supply flow path side in the lateral direction, and the abutting portion 85 approach each other. When the positioning portion 215 and the abutting portion 85 come into contact with each other, it is possible to prevent the flow path member 210 from being further deformed. Among the side surfaces of the flow path member 210 extending in the longitudinal direction, the positioning portion 215 is formed at the side surface 210A located on the common supply flow path side in the lateral direction, so that the position of the flow path member 210 in the lateral direction can be appropriately defined by the positioning portion 215 and the abutting portion 85.

Figure 10:
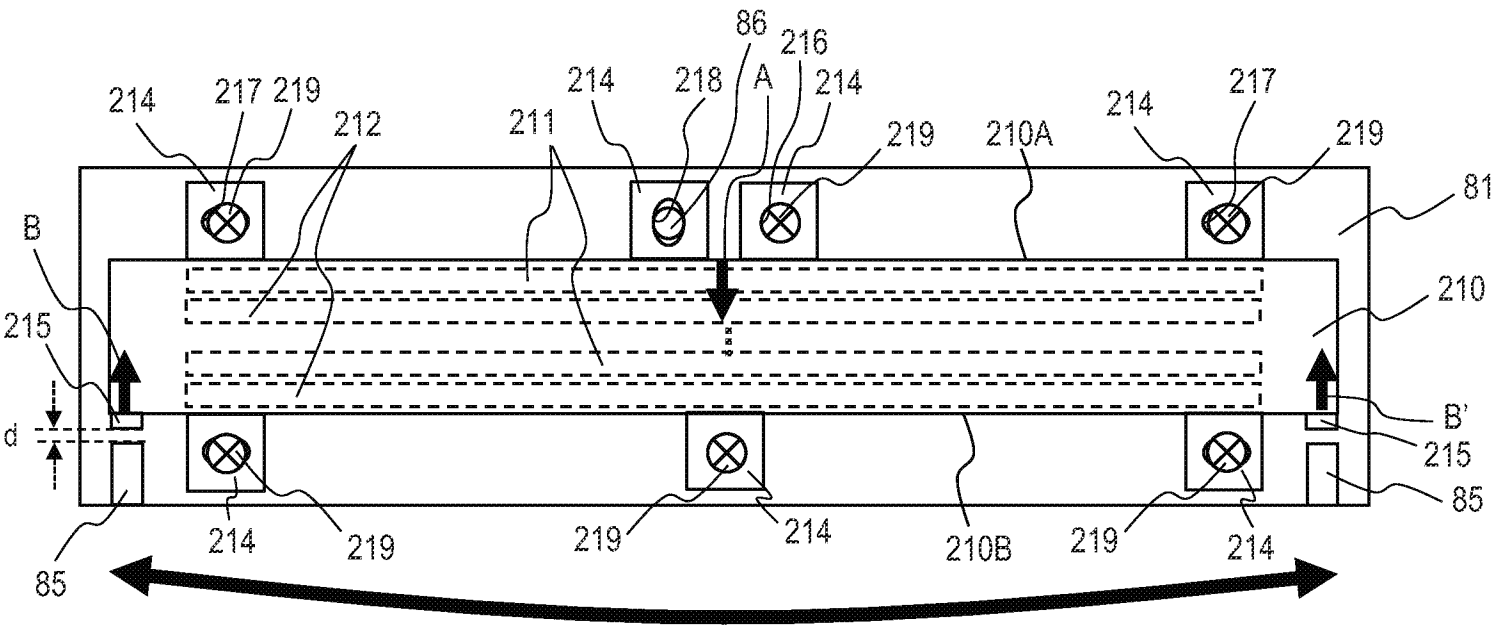
FIG. 10 is a schematic plan view illustrating a deformed state of a flow path member between the flow path member and a support member according to a comparative example.

In a comparative example illustrated in FIG. 10, positions of the common supply flow path 211 and the common collection flow path 212 are different, as compared with the example illustrated in FIG. 9. As a result, among the side surfaces of the flow path member 210 extending in the longitudinal direction, the positioning portion 215 is formed at the side surface 210B located on the common collection flow path side in the lateral direction, and the abutting portion 85 is formed at a position facing the positioning portion 215. In this case, the force indicated by arrows A, B, and B' acts due to a difference between the thermal expansion on the common collection flow path 212 side and the thermal expansion on the common supply flow path 211 side of the flow path member 210, and as schematically illustrated by an arrow in FIG. 10, the flow path member 210 causes a deformation opposite to the deformation illustrated in FIG. 9. That is, the flow path member 210 is deformed such that the interval d between the positioning portion 215 and the abutting portion 85 becomes large. Therefore, the positioning portion 215 and the abutting portion 85 do not come into contact with each other, and do not contribute to the definition of the position of the flow path member 210 in the lateral direction. Therefore, as illustrated in FIG. 9, a configuration can be used in which among the side surfaces of the flow path member 210 extending in the longitudinal direction, the positioning portions 215 are formed at both end portions of the side surface 210A in the longitudinal direction located on the common supply flow path side in the lateral direction and the abutting portion 85 is formed at positions facing the positioning portions 215. According to such a configuration, the position of the flow path member 210 in the lateral direction can be appropriately defined.

In the present exemplary embodiment, as described above, the position of the flow path member 210 with respect to the support member 81 in the longitudinal direction is defined by the positioning slot 218 and the positioning pin 86, at the center portion in the longitudinal direction. The position of the flow path member 210 with respect to the support member 81 in the lateral direction is defined by the positioning portion 215 and the abutting portion 85, on both side portions in the longitudinal direction. Further, a position of the flow path member 210 with respect to the support member 81 in the thickness direction is fixed while being defined by the screw 219, at least in the center portion in the longitudinal direction. As a result, the deformation of the flow path member 210 with respect to the support member 81 can be suppressed to a small extent.

Other Exemplary Embodiments

Figure 11:
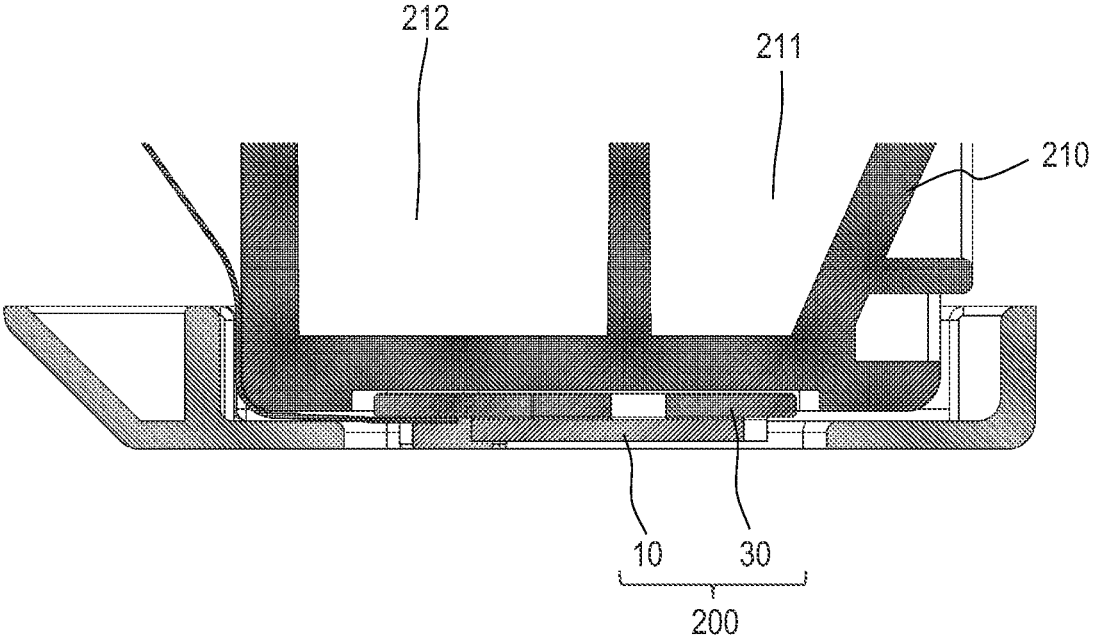
FIG. 11 is a cross-sectional view of a part of a liquid ejection head according to another exemplary embodiment of the present disclosure cut along a lateral direction.

FIG. 11 is a cross-sectional view of a liquid ejection head according to another exemplary embodiment of the present disclosure cut along the lateral direction. In the configuration illustrated in FIGS. 5 and 9, the common supply flow paths 211*a* to 211*d* and the common collection flow paths 212*a* to 212*d* of each color are alternately arranged in the lateral direction of the flow path member 210. On the other hand, in the present exemplary embodiment, only one set of the common supply flow path 211 and the common collection flow path 212 are arranged side by side in the lateral direction of the flow path member 210. In the same manner as the configuration illustrated in FIG. 5, the outermost flow path on the flexible wiring substrate (not illustrated) side (left side in FIG. 5) of the flow path member 210 is the common collection flow path 212.

Figure 12A:
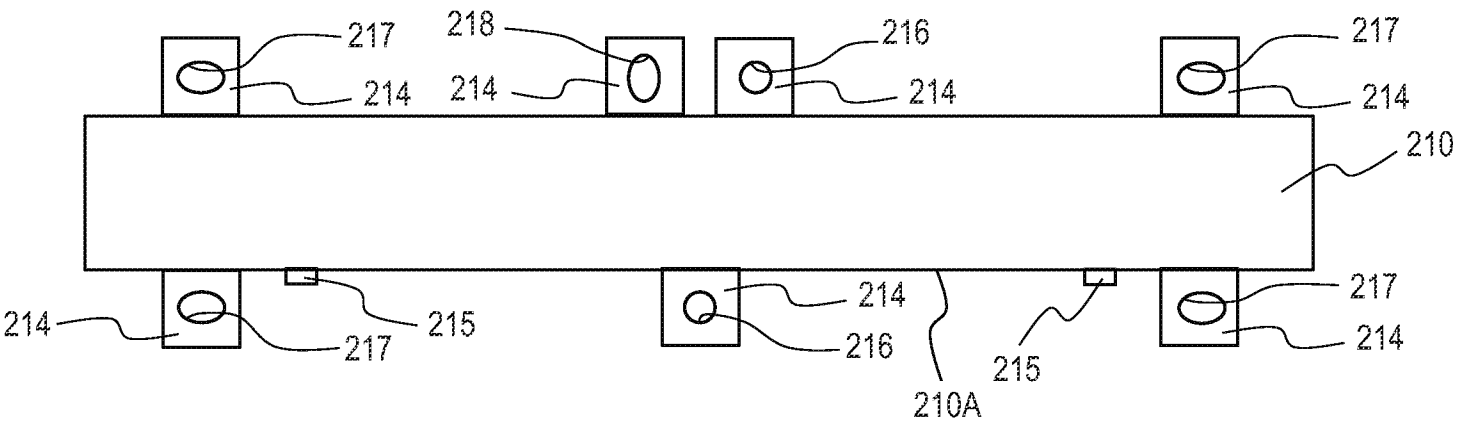
FIG. 12A is a schematic plan view of a flow path member of the liquid ejection head illustrated in FIG. 11.
Figure 12B:
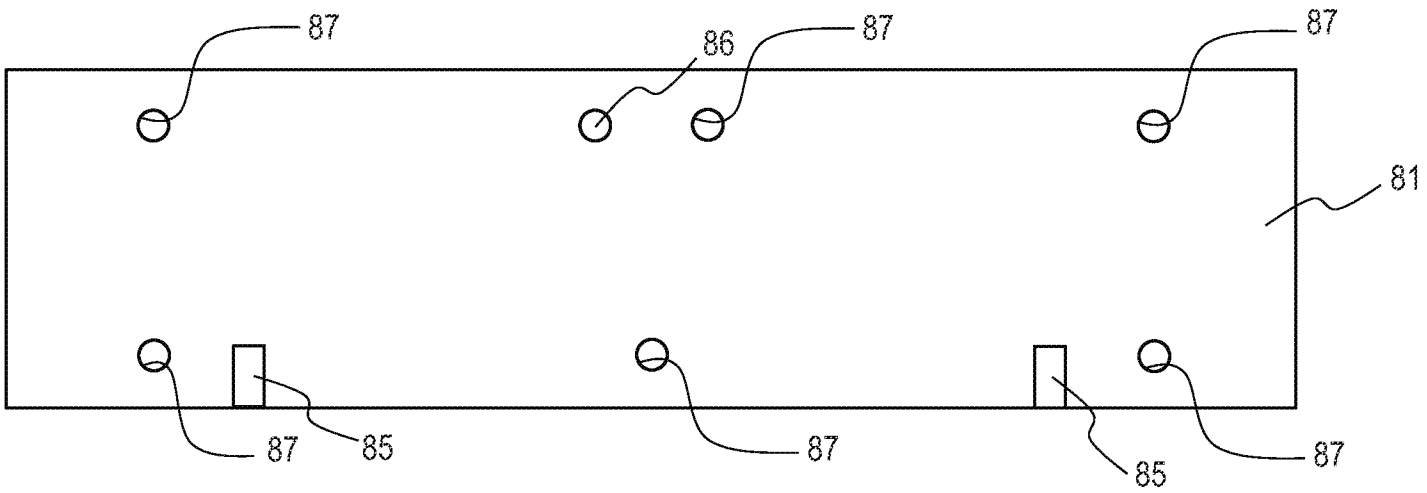
FIG. 12B is a schematic plan view of a support member of the flow path member of the liquid ejection head illustrated in FIG. 11.
Figure 13A:
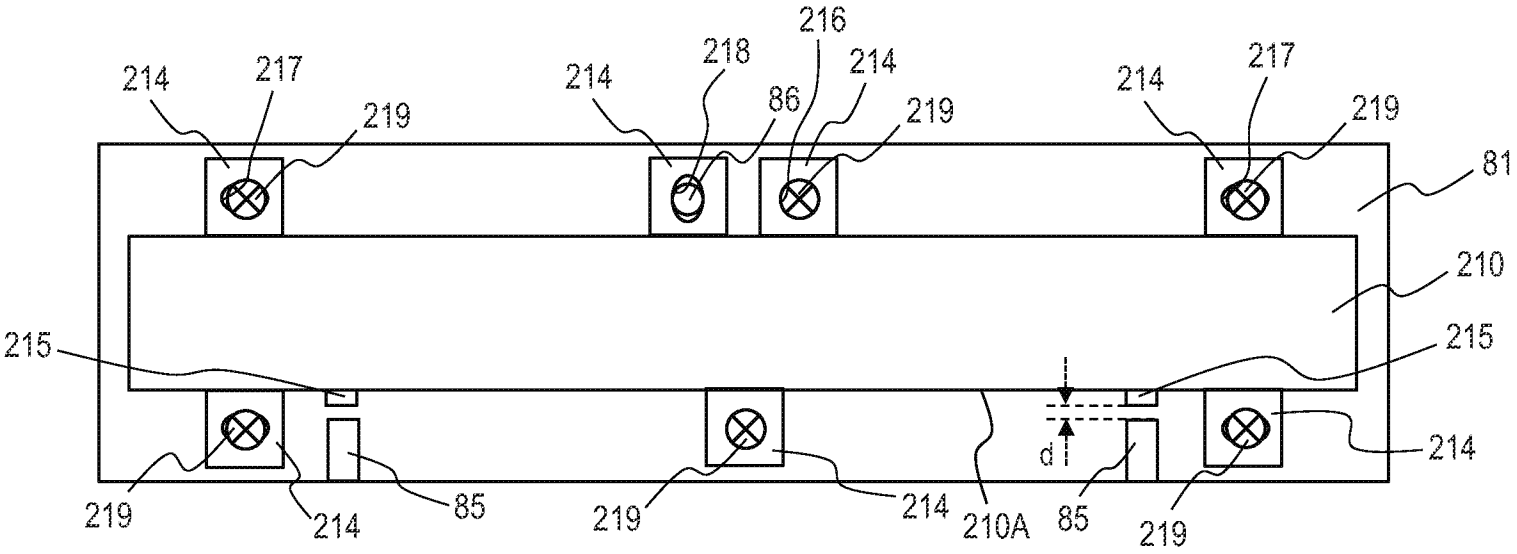
FIG. 13A is a schematic plan view illustrating a fixed state between the flow path member and the support member illustrated in FIGS. 12A and 12B.
Figure 13B:
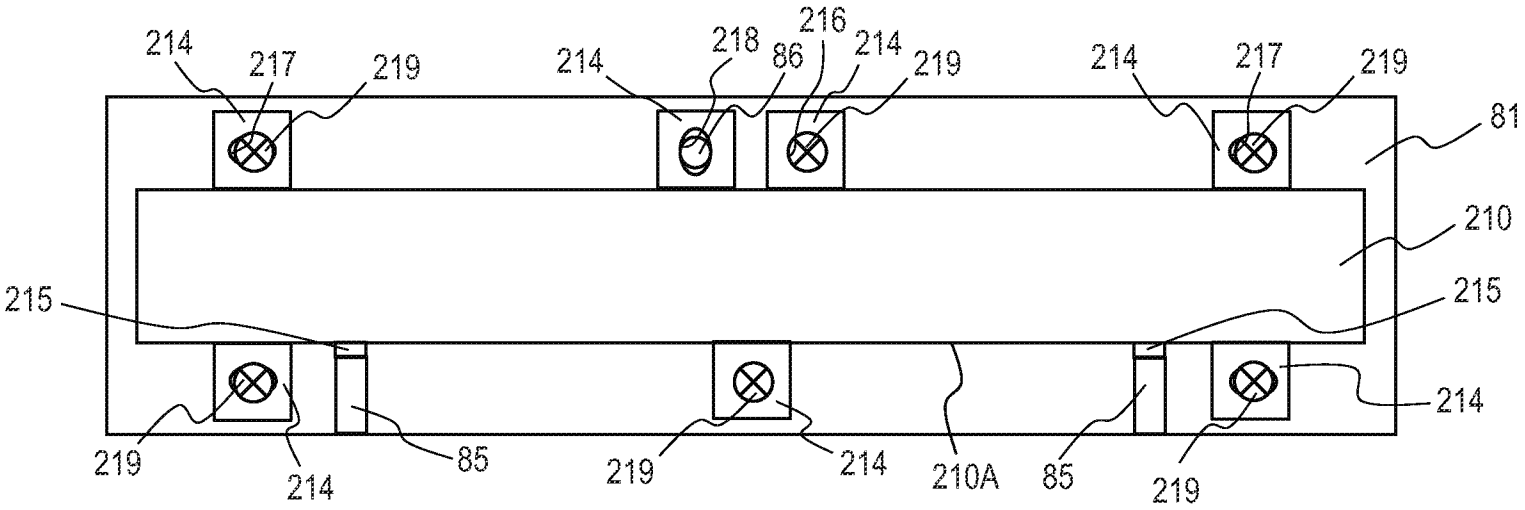
FIG. 13B is another schematic plan view illustrating the fixed state between the flow path member and the support member illustrated in FIGS. 12A and 12B.
Figure 13C:
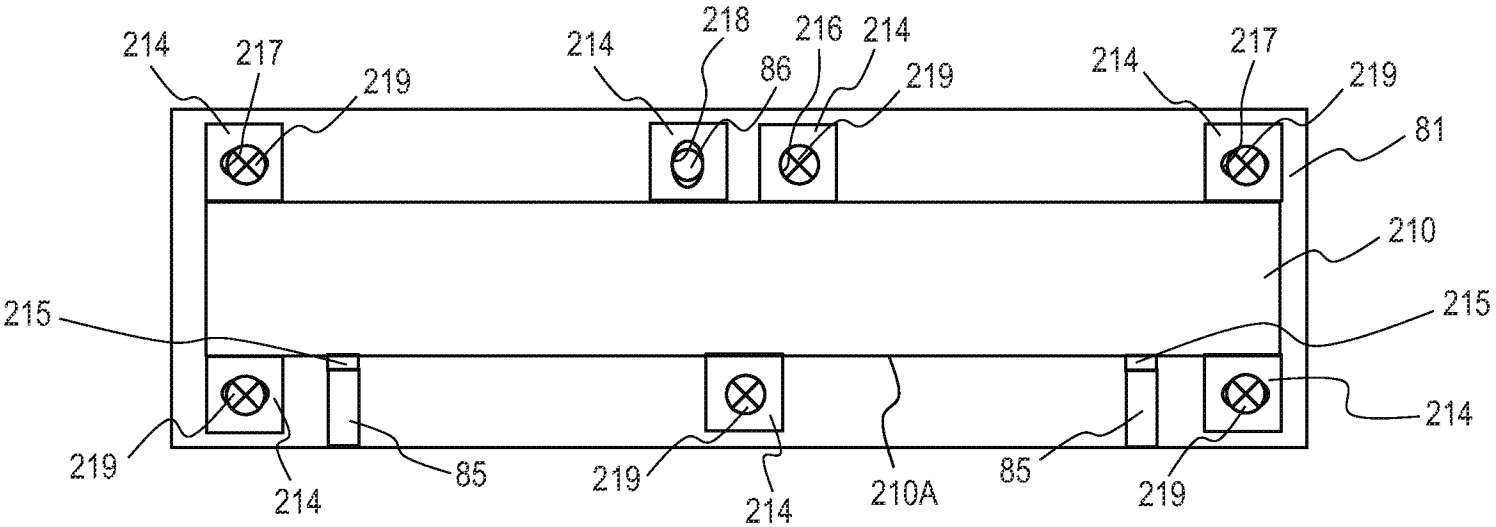
FIG. 13C is still another schematic plan view illustrating the fixed state between the flow path member and the support member illustrated in FIGS. 12A and 12B.

FIG. 12A is a schematic plan view of the flow path member 210 according to the present exemplary embodiment. FIG. 12B is a schematic plan view of the support member 81 according to the present exemplary embodiment. FIGS. 13A, 13B, and 13C are schematic plan views illustrating a fixed state of the flow path member 210 according to the present exemplary embodiment. FIGS. 12A, 12B, 13A, 13B, and 13C illustrate a part of a configuration simplified for easy understanding. In the configuration illustrated in FIG. 9, in the flow path member 210, the positioning portion 215 is formed on the longitudinal end portion side than the fixing portions 214, on both side portions in the longitudinal direction. Also in the present exemplary embodiment, the positioning portion 215 is formed on the side surface 210A (see FIG. 14) located on the common supply flow path 211 side in the lateral direction, among the side surfaces of the flow path member 210 extending in the longitudinal direction. In the present exemplary embodiment, as illustrated in FIG. 13A, the positioning portions 215 are formed on the center portion side in the longitudinal direction with respect to the fixing portions 214 on both side portions of the flow path member 210 in the longitudinal direction. The abutting portion 85 is formed at a position facing the positioning portion 215. As a result, as illustrated in FIG. 13C, a dimension of the flow path member 210 and the support member 81 in the longitudinal direction can be shortened, and a dimension of the liquid ejection head 3 in the longitudinal direction can be reduced. As a result, the overall amount of deformation can be reduced.

As illustrated in FIG. 13A, the flow path member 210 and the support member 81 may be fixed with the interval d of, for example, 50 μm or less between the positioning portion 215 and the abutting portion 85. Meanwhile, as illustrated in FIGS. 13B and 13C, the positioning portion 215 and the abutting portion 85 may abut against each other.

Also in the present exemplary embodiment, the flow path member 210 is held at the center portion in the longitudinal direction so as to be movable in the lateral direction and immovable in the longitudinal direction with respect to the support member 81, by the positioning pin 86 of the support member 81 and the positioning slot 218 of the flow path member 210. Further, the position of the flow path member 210 in the lateral direction with respect to the support member 81 is defined by the positioning portion 215 and the abutting portion 85, at both side portions in the longitudinal direction. The position of the flow path member 210 with respect to the support member 81 in the thickness direction is fixed while being defined by the screw 219, at least in the center portion in the longitudinal direction. In this manner, the flow path member 210 is fixed to the support member 81 with high positional accuracy, and warpage of the flow path member 210 in the thickness direction is suppressed.

Figure 14:
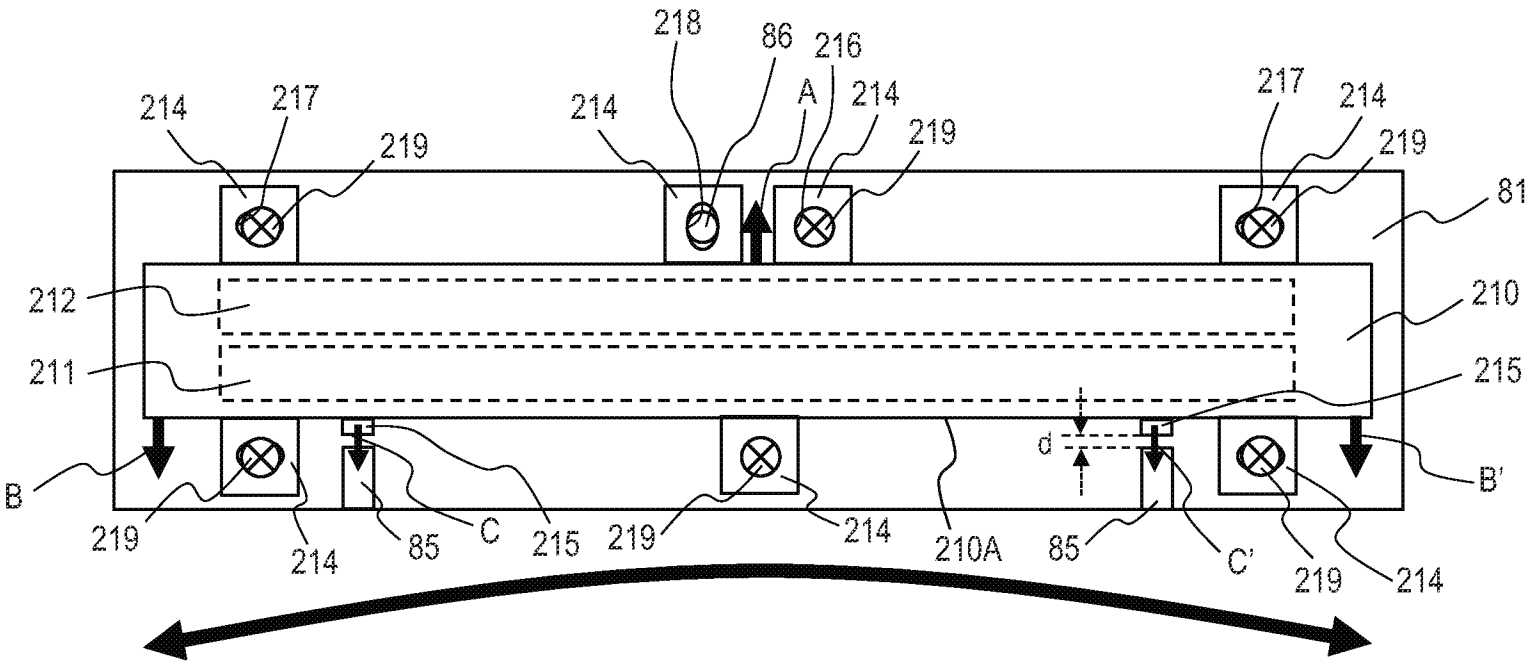
FIG. 14 is a schematic plan view illustrating a deformed state of the flow path member between the flow path member and the support member illustrated in FIG. 13A.

FIG. 14 is a schematic diagram illustrating a deformed state of the flow path member 210 along the longitudinal direction of the flow path member 210. FIG. 14 illustrates a part of a configuration simplified for ease understanding. As illustrated in FIGS. 11 and 14, in the flow path member 210, a set of the common supply flow path 211 and the common collection flow path 212 extending in the longitudinal direction of the flow path member 210 are formed so as to be arranged side by side with each other in the lateral direction of the flow path member 210. As described above, the liquid flowing through the common collection flow path 212 has a higher temperature than the liquid flowing through the common supply flow path 211. A temperature distribution is generated in the common supply flow path 211 and the common collection flow path 212, and the flow path member 210 is deformed as schematically illustrated by an arrow in FIG. 14. That is, since thermal expansion of the flow path member 210 on the common collection flow path 212 side is larger than thermal expansion on the common supply flow path 211 side, force indicated by arrows A, B, B', C, and C' in FIG. 14 acts and the flow path member 210 is deformed. This deformation has the same direction as the deformation direction of the example illustrated in FIG. 9, and the temperature distribution is large since the number of the common supply flow path 211 and the common collection flow path 212 in the flow path member 210 is small. As described above, the larger the temperature difference in the lateral direction of the flow path member 210 and the longer the flow path member 210, the greater the deformation of the flow path member 210. On the other hand, in the present exemplary embodiment, by defining the position of the flow path member 210 in the longitudinal direction with the fixing portion 214 at the center portion of the flow path member 210 in the longitudinal direction, the deformation of the flow path member 210 is suppressed against the force of the arrow A in FIG. 14. Further, when the positioning portion 215 abuts the abutting portion 85, the deformation of the flow path member 210 in the lateral direction is suppressed against the force of the arrows C and C'. As illustrated in FIGS. 13B and 13C, by abutting the abutting portion 85 against the positioning portion 215 from the beginning, the deformation of the flow path member 210 can be suppressed more appropriately. Further, the abutting portion 85 can be fixed to the positioning portion 215 by a method such as adhesion to suppress the deformation of the flow path member 210.

As described above, in the present disclosure, the position of the flow path member 210 with respect to the support member 81 in the longitudinal direction is defined by the positioning slot 218 and the positioning pin 86, at the center portion in the longitudinal direction. The position of the flow path member 210 with respect to the support member 81 in the lateral direction is defined by the positioning portion 215 and the abutting portion 85, on both side portions in the longitudinal direction. Further, a position of the flow path member 210 with respect to the support member 81 in the thickness direction is fixed while being defined by the screw 219, at least in the center portion in the longitudinal direction. That is, instead of positioning the flow path member 210 in all the directions at the same location, the position in the longitudinal direction, the position in the lateral direction, and the position in the thickness direction are respectively defined in different portions. Therefore, the flow path member 210 can be positioned in each direction with high accuracy without distortion at each portion. In particular, since positioning of the flow path member 210 in the longitudinal direction is performed at the center portion in the longitudinal direction, deformation in the longitudinal direction can be efficiently suppressed. Further, positioning of the flow path member 210 in the lateral direction is performed at both side portions in the longitudinal direction of the side surface located on the common supply flow path side having a relatively low-temperature in the lateral direction. As a result, it is possible to regulate deformation at a portion at which deformation of the flow path member 210 in the lateral direction is likely to occur, and the deformation in the lateral direction can be efficiently suppressed. When positioning of the flow path member 210 in the thickness direction is performed at a plurality of locations of an outer peripheral portion of the flow path member, deformation in the thickness direction can be suppressed more appropriately. In this manner, when the temperature distribution of the common supply flow path 211 and the common collection flow path 212 causes the flow path member 210 to be deformed in the lateral direction, deformation of the flow path member 210 in each direction can be suppressed. As a result, it is possible to provide the liquid ejection head capable of ejecting a liquid with high accuracy and high quality.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2021-061614, filed Mar. 31, 2021, which is hereby incorporated by reference herein in its entirety.

What is claimed is:

1. A liquid ejection head comprising:

a recording element substrate having an ejection orifice which ejects a liquid;

a flow path member having a common supply flow path through which the liquid is supplied to the recording element substrate, and a common collection flow path which collects the liquid from the recording element substrate and through which a liquid having a temperature higher than a temperature of the liquid flowing through the common supply flow path flows; and a support member which supports the flow path member, wherein the common supply flow path and the common collection flow path extends along a longitudinal direction of the flow path member, and are formed side by side with each other in a lateral direction of the flow path member, and a position of the flow path member with respect to the support member in the longitudinal direction is defined at a center portion in the longitudinal direction, a position of the flow path member in the lateral direction is defined at a side surface located on the common supply flow path side in the lateral direction, among side surfaces extending in the longitudinal direction, and a position of the flow path member with respect to the support member in a thickness direction is fixed while being defined at least in the center portion in the longitudinal direction.

2. The liquid ejection head according to claim 1, wherein a plurality of the recording element substrates are provided, wherein the flow path member supports the plurality of the recording element substrates and includes a plurality of individual supply flow paths respectively connected to the recording element substrates and a plurality of individual collection flow paths respectively connected to the recording element substrates, and wherein the common supply flow path is connected to the plurality of individual supply flow paths, and the common collection flow path is connected to the plurality of individual collection flow paths.

3. The liquid ejection head according to claim 2, wherein the plurality of recording element substrates are arranged on the flow path member in a state in which at least parts of the recording element substrates overlap with each other.

4. The liquid ejection head according to claim 1, wherein the flow path member includes a plurality of fixing portions fixed to the support member and a positioning portion positioned with respect to the support member, the positioning portion is provided at the side surface located on the common supply flow path side of the flow path member in the lateral direction, among the side surfaces of the flow path member extending in the longitudinal direction, and among the plurality of fixing portions, fixing portions located at the center portion in the longitudinal direction include a fixing portion which defines the position with respect to the support member in the longitudinal direction and a fixing portion which fixes while defining the position with respect to the support member in the thickness direction.

5. The liquid ejection head according to claim 4, wherein among the fixing portions located at the center portion in the longitudinal direction, the fixing portion which defines the position with respect to the support member in the longitudinal direction includes a positioning slot having a major axis in the lateral direction, and the fixing portion which fixes while defining the position with respect to the support member in the thickness direction includes a screw through-hole, among the plurality of fixing portions, fixing portions located on both side portions in the longitudinal direction have screw through-holes, the support member has a positioning pin at a position facing the positioning slot, the positioning pin is inserted into the positioning slot, and the flow path member is held so as to be relatively movable to the support member in the lateral direction, within a range in which the positioning pin is located in the positioning slot, and the flow path member is fixed to the support member by a screw screwed into the support member via the screw through-hole.

6. The liquid ejection head according to claim 5, wherein among the plurality of the fixing portions, the screw through-holes included in the fixing portions located on both side portions in the longitudinal direction have slot shapes having a major axis in the longitudinal direction.

7. The liquid ejection head according to claim 4, wherein the positioning portion is formed on a center portion side in the longitudinal direction with respect to the fixing portions located on both side portions of the flow path member in the longitudinal direction.

8. The liquid ejection head according to claim 4, wherein the support member includes an abutting portion facing the positioning portion, and an interval between the positioning portion and the abutting portion is equal to or less than 50 μm.

9. The liquid ejection head according to claim 4, wherein the plurality of fixing portions are formed side by side along an outer periphery of the flow path member.

10. The liquid ejection head according to claim 1, wherein the flow path member includes a plurality of plate-shaped members stacked in the thickness direction.

11. The liquid ejection head according to claim 1, wherein a linear expansion rate of a material of the support member is equal to or less than a linear expansion rate of a material of the flow path member.

12. The liquid ejection head according to claim 1, wherein the recording element substrate includes a heat generating portion.

13. The liquid ejection head according to claim 12, wherein the heat generating portion is an energy generating element that generates heat energy for ejecting the liquid in the recording element substrate from the ejection orifice.

14. The liquid ejection head according to claim 12, wherein the heat generating portion is a temperature adjusting element that adjusts a temperature of the liquid in the recording element substrate.

15. The liquid ejection head according to claim 12, wherein the heat generating portion includes a temperature adjusting element that adjusts a temperature of the liquid in the recording element substrate, and an energy generating element that generates heat energy for ejecting the liquid in the recording element substrate from the ejection orifice.

16. The liquid ejection head according to claim 1, wherein the liquid ejection head is a line-type liquid ejection head having a recording width corresponding to a recording target width of a recording target medium.

17. A manufacturing method of a liquid ejection head including a recording element substrate having an ejection orifice which ejects a liquid; a flow path member having a common supply flow path through which the liquid is supplied to the recording element substrate, and a common collection flow path which collects the liquid from the recording element substrate and through which a liquid having a temperature higher than a temperature of the liquid flowing through the common supply flow path flows; and a support member which supports the flow path member, the common supply flow path and the common collection flow path being formed to extend along a longitudinal direction of the flow path member, and be arranged side by side with each other in a lateral direction of the flow path member, the method comprising:

defining a position of the flow path member in the longitudinal direction while being movable to the support member in the lateral direction by inserting a positioning pin into a positioning slot, at a center portion of the flow path member in the longitudinal direction;

subsequently defining a position of the flow path member in the lateral direction, on a side surface located on the common supply flow path side in the lateral direction, among side surfaces extending in the longitudinal direction, by an abutting portion provided at the support member; and subsequently fixing while defining a position of the flow path member with respect to the support member in a thickness direction at least in the center portion in the longitudinal direction.

* * * * *